US006422827B1

(12) United States Patent
Hara

(10) Patent No.: US 6,422,827 B1
(45) Date of Patent: Jul. 23, 2002

(54) INJECTION APPARATUS FOR GAS-LIQUID MIXED FLOW

(75) Inventor: Shinichi Hara, Ishikawa (JP)

(73) Assignee: Shibuya Kogyo Co., Ltd., Ishikawa (JP)

( * ) Notice: Subject to any disclaimer, the term of this patent is extended or adjusted under 35 U.S.C. 154(b) by 0 days.

(21) Appl. No.: 09/626,077

(22) Filed: Jul. 26, 2000

(30) Foreign Application Priority Data

Jul. 26, 1999 (JP) ..... 11-210081

(51) Int. Cl.[7] ..... F04F 5/00
(52) U.S. Cl. ..... 417/151; 239/419; 239/433
(58) Field of Search ..... 417/76, 84, 87, 417/88, 89, 203, 151, 118; 239/419, 419.3, 422, 423, 428, 434.5, 433

(56) References Cited

U.S. PATENT DOCUMENTS 4,422,830 A * 12/1983 Perkins ..... 417/54
6,012,647 A * 1/2000 Ruta et al. ..... 239/132.1
6,161,778 A * 12/2000 Haruch ..... 239/290
6,250,567 B1 * 6/2001 Lewis et al. ..... 239/292
6,253,963 B1 * 7/2001 Tachibana ..... 222/129.1

FOREIGN PATENT DOCUMENTS

JP 60261566 12/1985 ..... B05B/7/06
JP 5-63658 8/1993 ..... B05B/7/04

* cited by examiner

*Primary Examiner*—Charles G. Freay
*Assistant Examiner*—W Rodriguez

(57) ABSTRACT

A flow path for the pressure gas which is to be connected to a pressure gas feeder is formed almost rectilinearly, a liquid reservoir chamber to be connected to a pressure liquid feeder is provided in the flow path for the pressure gas. The sectional area of the flow path for the pressure fluid is gradually reduced to form an accelerating portion, an injection port for a liquid injection nozzle communicating with the liquid reservoir chamber is provided in the acceleration portion and a gas injection port is formed on the outside to enclose the injection port of the liquid injection nozzle. A powder and granular material may be mixed into the pressure gas or the pressure liquid, or a detergent may be added into the pressure liquid.

10 Claims, 7 Drawing Sheets

INJECTION APPARATUS FOR GAS-LIQUID MIXED FLOW

BACKGROUND OF THE INVENTION

1. Field of the Invention

The present invention relates to an injection apparatus of a gas-liquid mixed flow which is suitable for a jet flow to be used for variously washing automobiles, wall surfaces of buildings, bottles and dishes.

The present application is based on Japanese Patent Application No. Hei. 11-210081, which is incorporated herein by reference.

2. Description of the Related Art

As this kind of injection apparatus for a gas-liquid mixed flow, there has been known a type in which the gas injection port side is provided on the outside to enclosed the injection port of a liquid injection nozzle (Unexamined Japanese Patent Publication No. Sho. 60-261566) and a type in which the liquid injection side is provided on the outside to enclosed the injection port of the gas injection nozzle (Unexamined Japanese Utility Model Publication No. Hei. 5-63658). In the invention, there has been employed a type in which the gas injection port is provided on the outside of the injection port of the liquid injection nozzle. Referring to the introduction of a pressure gas to the injection apparatus according to the related art of the former type, it has been known that a gas flow path having an annular section is formed to enclose a rectilinear liquid flow path positioned in the central portion and a gas introducing duct is connected in a vertical direction with respect to the flow path having the annular section (see the above-mentioned publication). However, the pressure gas flowing through the introducing duct changes the direction of the flow vertically during the introduction. For this reason, the resistance of the flow path is correspondingly increased, and furthermore, the introducing duct is partially connected to a part of the circumference of the gas flow path having the annular section. Consequently, it has been technically hard to distribute the flow of the pressure gas in the gas flow path uniformly with respect to the annular section. For this reason, there have been technological drawbacks.

More specifically, the outflow speed of the pressure gas is increased, the flow of the pressure gas in the gas flow path is disturbed easily so that the gas-liquid mixed flow jetted from the nozzle is also affected. Consequently, a uniform and stable mixed flow is damaged easily. Moreover, if the disturbance of the flow of the pressure gas in the gas flow path is increased, the injection state is easily unstable. Therefore, an adjustable range related to the injection state also tends to be reduced. It has also been suggested that the number of introducing ducts to be installed is increased to introduce the pressure gas from a plurality of portions on the circumference of the gas path flow. However, the structure is made complicated and the formation of the uniform flow is restricted based on a structure.

SUMMARY OF THE INVENTION

In consideration of the above-mentioned conventional technological circumstances, the present invention has been developed and has an object to avoid an increase in the resistance of a flow path in a portion for introducing a pressure gas to an injection apparatus and to improve a uniform flow for the pressure gas to be obtained more smoothly with a simple structure, thereby enhancing the uniformity and stability of the gas-liquid mixed flow jetted from the nozzle and enlarging an adjustable range related to the injection state.

In order to solve the above-mentioned problem, the invention provides an injection apparatus for a gas-liquid mixed flow which mixes and injects at least a pressure gas and a pressure liquid, a flow path for the pressure gas which is to be connected to a pressure gas feeder is formed almost rectilinearly, a liquid reservoir chamber to be connected to a pressure liquid feeder is provided in the flow path for the pressure gas, a sectional area of the flow path for the pressure fluid is gradually reduced to form an accelerating portion, an injection port for a liquid injection nozzle communicating with the liquid reservoir chamber is provided in the acceleration portion and a gas injection port is formed outside the injection port of the liquid injection nozzle. As described above, in the invention, the flow path for the pressure gas in the injection apparatus is formed almost rectilinearly. Therefore, the resistance of the flow path can be reduced. In addition, the pressure gas can flow smoothly without disturbance differently from the conventional example and the stable and good injection state having a large adjustable range can be obtained.

A gas injection port can be formed by an internal wall surface of the accelerating portion and an external wall surface of the liquid injection nozzle. Moreover, a throttling portion having a sectional area reduced may be provided on a nozzle for mixed flow injection on a downstream of the gas injection port. Furthermore, a plurality of injection ports may be provided on the liquid injection nozzle. In that case, the injection ports of the liquid injection nozzle may be arranged in a line and the gas injection port is formed flatly. Moreover, a part for forming the accelerating portion may be constituted exchangeably. Furthermore, a powder and granular material feeding portion may be provided on an upstream side of the injection port of the pressure gas. In that case, a liquid feeding portion for preventing residence of the powder and granular material may be provided on a downstream side of the powder and granular feeding portion. Moreover, a powder and granular material feeding portion ma be provided on an upstream side of the injection port of the pressure liquid. A detergent can be mixed into the pressure liquid.

Features and advantages of the invention will be evident from the following detailed description of the preferred embodiments described in conjunction with the attached drawings.

DETAILED DESCRIPTION OF THE PREFERRED EMBODIMENTS

An embodiment of the invention is suitable for an injection apparatus to be used for variously washing automobiles, wall surfaces of buildings, bottles and dishes. As described above, it is sufficient that at least a gas-liquid mixed flow of a gas and a liquid is formed. It is also possible to mix a proper powder and granular material such as a polishing and cleaning material such as sodium hydrogencarbonate or alumina. Furthermore, a high-temperature gas or vapor may be used as the pressure gas to enhance detergency or an additive such as a surfactant may be added into the pressure liquid if necessary. Preferably, the liquid reservoir provided on the inside of the rectilinear flow path is provided on upstream of the injection port of the liquid injection nozzle and has some pressure accumulation volume and functions to smooth a pressure. Moreover, the form of the gas-liquid mixed flow injected from the injection apparatus can be adjusted depending on the specific dimension of each portion of the injection apparatus and the condition for introducing a pressure gas or a pressure liquid which is supplied to the injection apparatus. In the main form, a large amount of pressure gas is mainly added and a proper amount of liquid is added. The size of a droplet constituting the gas-liquid mixed flow including a fine foggy droplet and a big particle can be set depending on the treatment form by increasing or decreasing the amount of injection of the liquid supplied from the liquid injection nozzle, for example. If the nozzle for injecting a gas-liquid mixed flow and the liquid injection nozzle can be exchanged with each other and the size and the shape are varied, it is also possible to change, through the exchange of the nozzles, the size of each injection port, the state of inclination of the wall surface of the accelerating portion, the inside diameter of the nozzle and the spreading angle of a jet flow depending on the circumstances. For the pressure gas feeder, a blower such as a Roots blower or a turboblower, a reciprocating compressor or a rotary compressor, or a steam supply source can be selected and used. For the pressure liquid feeder, similarly, a non-volume type pump such as a turbopump or a volume type pump such as a reciprocating pump or a rotary pump can be selected and used.

Figure 1:
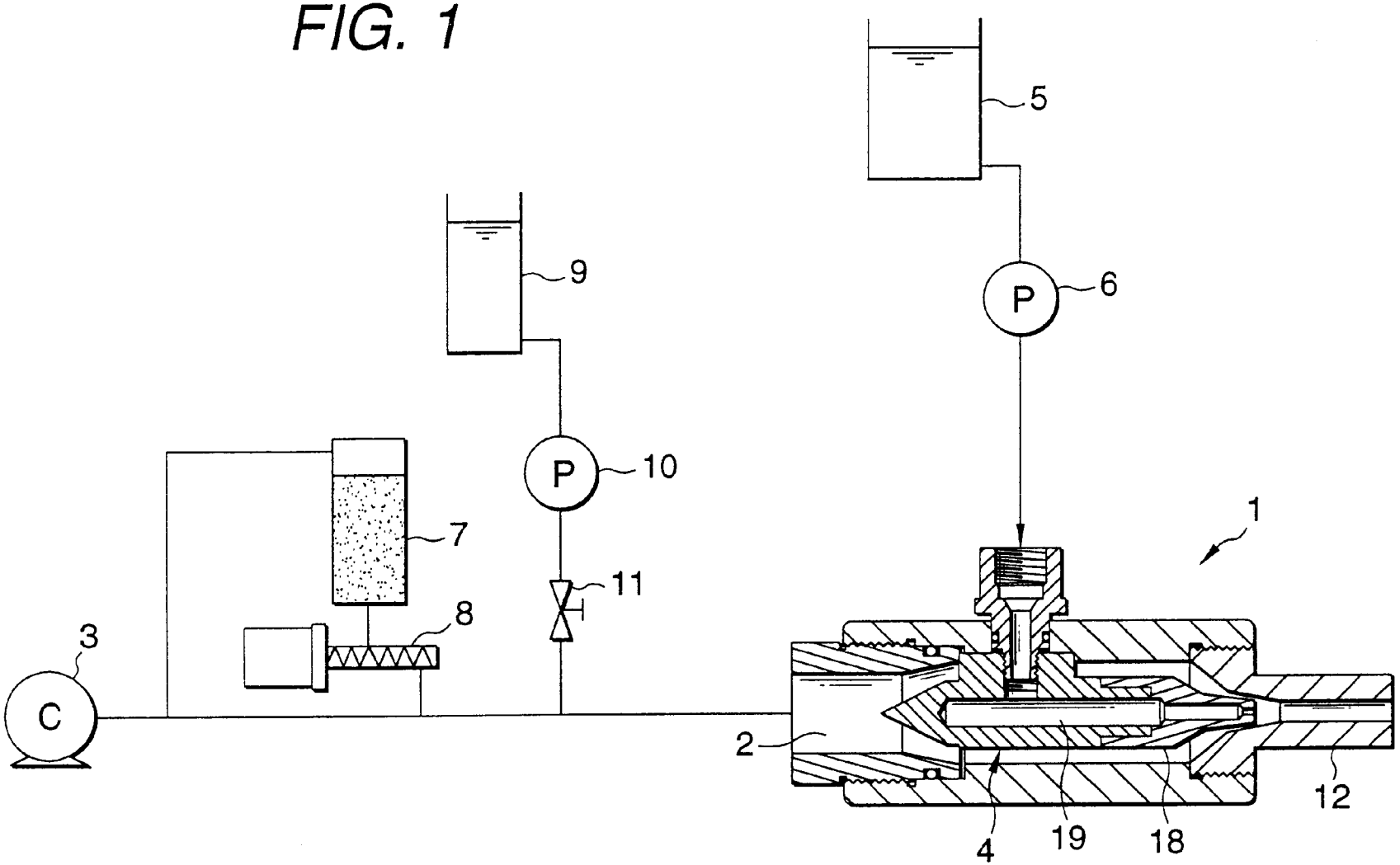
FIG. 1 is a diagram schematically showing a circuit structure in a main part according to an embodiment in which the invention is applied to washing use.

An embodiment of the present invention will be described below with reference to the drawings. FIG. 1 is a circuit diagram schematically showing the main part of an embodiment in which the invention is applied to washing use. In FIG. 1, the reference numeral 1 denotes an injection apparatus according to the invention. A pressure gas feeder comprising a compressor 3 is connected to the introducing port of a pressure gas flow path 2 which is formed almost rectilinearly in the injection apparatus 1. On the other hand, a pressure liquid feeder comprising a water tank 5 and a pump 6 is connected to the introducing port of a liquid reservoir 4 provided on the inside of the rectilinear flow path 2. In the present embodiment, a powder and granular material feeder comprising a powder and granular material reservoir tank 7 and a delivery device 8 such as a screw conveyer is connected to the downstream side of the compressor 3. Furthermore, a liquid feeder comprising a water tank 9 for preventing residence or condensation and a pump 10 which serves to prevent the powder and granular material from sticking to the internal wall of the flow path and washing the sticking powder and granular material is connected through a valve 11 to the downstream side of the powder and granular material feeder. The powder and granular material feeder and the liquid feeder for preventing the residence of the powder and granular material or the condensation can also be omitted depending on the circumstances. Moreover, the powder and granular material feeder can also be connected to the proper portion of a pressure liquid supply system connected to the introducing portion of the liquid reservoir 4 or the proper portion on this side of the injection port of the pressure gas.

In the use of the embodiment, a pressure gas is supplied from the compressor 3 into the flow path 2 of the injection apparatus 1 and pressure water is supplied from the water tank 5 to the liquid reservoir 4 through the pump 6. The pressure gas is rectilinearly propagated along the flow path 2, is accelerated in the accelerating section formed ahead thereof and is quickly injected from the gas injection port. The pressure liquid is injected from the liquid reservoir 4 toward the inside of the high-speed jet of the pressure gas supplied from the gas injection port, and both are mixed and are injected as a gas-liquid mixed flow from the nozzle 12. In this case, the pressure gas is moved almost rectilinearly in the injection apparatus 1. Therefore, the pressure gas flows smoothly without disturbance differently from the conventional art. Consequently, a stable and good injection state can be obtained within a wide range of mixing conditions. In the present embodiment, the pressure liquid flows in a direction orthogonal to an axis of the liquid reservoir 4, and is non-compressive and resides in a reservoir chamber formed in the liquid reservoir 4 so that a pressure is smoothed. Therefore, the influence of the inflow direction rarely makes troubles and a good injection state can be obtained.

Figure 2:
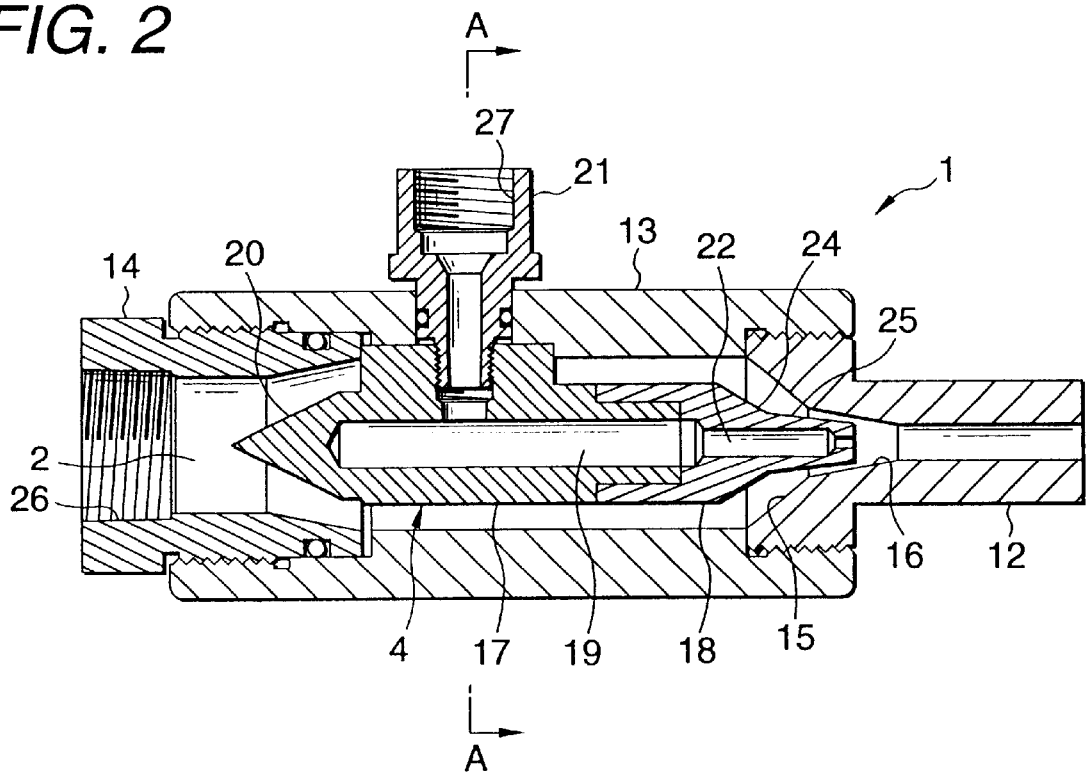
FIG. 2 is a longitudinal sectional view showing an injection apparatus according to an embodiment of the invention.
Figure 3:
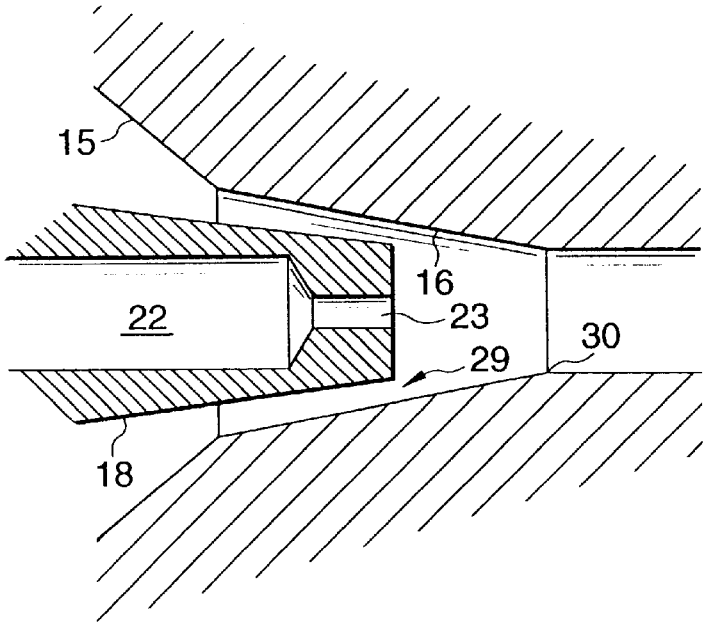
FIG. 3 is an enlarged longitudinal sectional view showing the tip portion of a liquid injection nozzle according to the embodiment.
Figure 4:
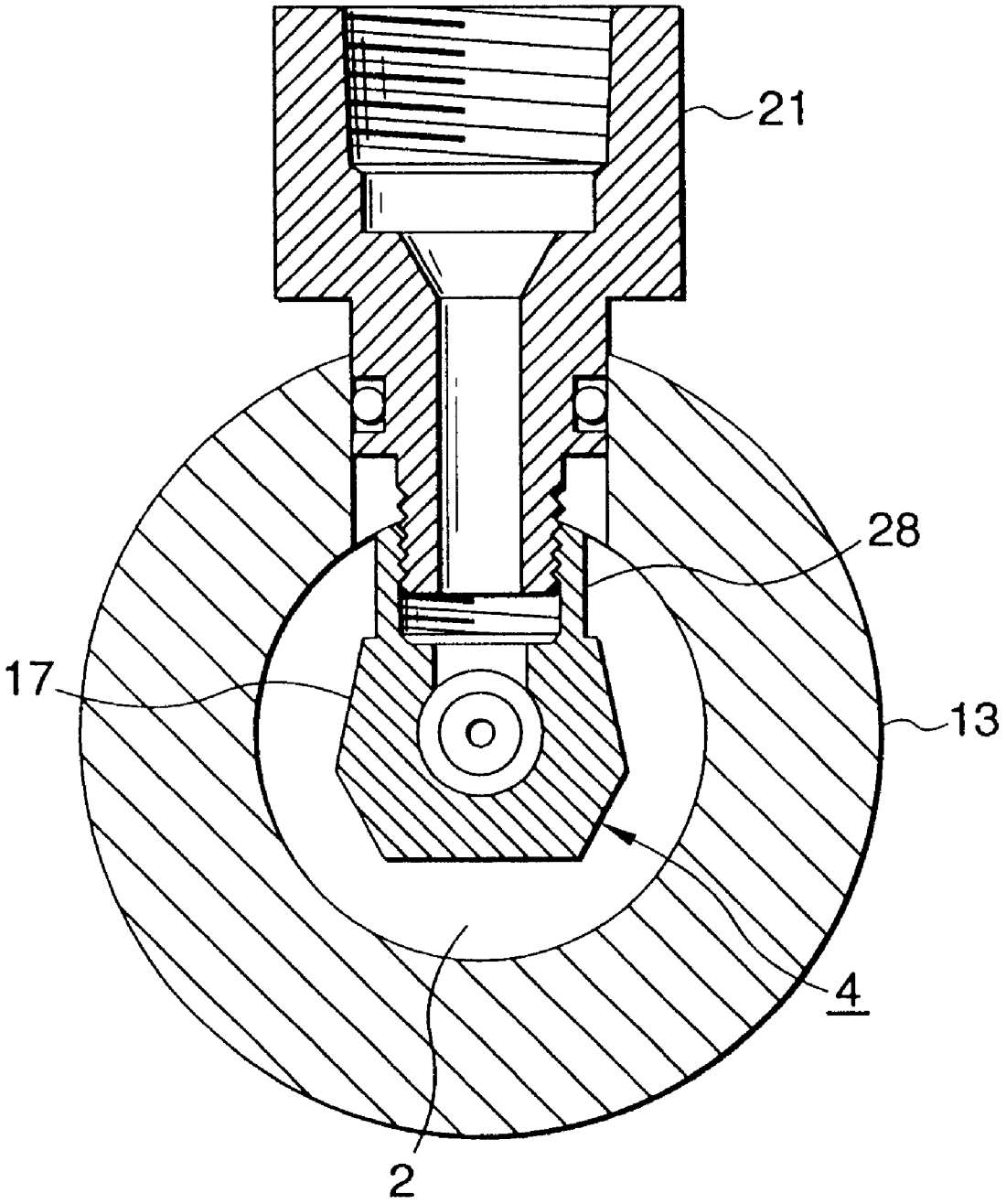
FIG. 4 is a sectional view taken along the line A—A shown in FIG. 2.

Next, the injection apparatus 1 will be described in detail. FIG. 2 is a longitudinal sectional view, FIG. 3 is an enlarged longitudinal sectional view showing the tip portion of the liquid injection nozzle, and FIG. 4 is a sectional view taken along the line A—A. As shown, the injection apparatus 1 according to the present embodiment comprises a cylindrical apparatus body 13, a gas introducing portion 14 screwed and coupled to the upstream side, and a nozzle 12 for a gas-liquid mixed flow screwed and coupled to the downstream side. A throttle portion having a sectional area reduced and serving to promote a mixture of a gas and a liquid can be provided in the downstream portion of a gas injection port of the nozzle 12 which will be described below. Moreover, an accelerating portion comprising 2-step inclined surfaces 15 and 16 having internal wall surfaces tapered is formed integrally on the upstream side of the nozzle 12. By preparing various shapes of the accelerating portion such as an inclination, it is also possible to perform exchange depending on the working conditions. A hole portion formed in the apparatus body 13 has a larger diameter than that of the gas introducing portion 14, and the liquid reservoir 4 is provided in the portion having a larger diameter. The liquid reservoir 4 is constituted by a reservoir body 17 and a liquid injection nozzle 18 screwed and coupled to the downstream side thereof. A liquid reservoir chamber 19 is formed in the reservoir body 17, and an external wall surface on the upstream side is formed on a tapered guide surface 20.

Furthermore, a liquid introducing port portion 21 is screwed and coupled to the reservoir body 17 with communication with the liquid reservoir chamber 19 in a vertical direction. Moreover, a flow path 22 communicating with the liquid reservoir chamber 19 is formed in the liquid injection nozzle 18, an injection port 23 is formed on a tip portion thereof as shown in FIG. 3, and an external surface on the downstream side is formed to form 2-step inclined surfaces 24 and 25. Female screws 26 and 27 for connecting a supply tube are formed on the upstream side of each passage of the introducing ports 14 and 21.

The liquid reservoir 4 is supported in the apparatus body 13 by screwing a screw shaft portion 28 into the liquid introducing part 21 to maintain a predetermined space defined between an inner peripheral surface of the apparatus main body 13 and an outer peripheral surface of the liquid reservoir 4 so as to form the flow path 2. More specifically, the flow path 2 is formed by the internal passage of the gas introducing port portion 14, a gap portion between the internal wall surface of the gas introducing port portion 14 and the guide surface 20 on the upstream side of the reservoir body 17, a gap portion between the internal wall surface of the apparatus body 13 and the external wall surfaces of the reservoir body 17 and the liquid injection nozzle 18, and a gap portion between the inclined surfaces 15 and 16 formed on the nozzle 12 and the inclined surfaces 24 and 25 formed on the liquid injection nozzle 18. The sectional area of the flow path 2 of a pressure fluid is gradually reduced to form the accelerating portion by the gap portion between the inclined surfaces 15 and 16 and the inclined surfaces 24 and 25, and a gas injection port 29 for a pressure gas is formed by the gap portion between the inclined surface 16 and the inclined surface 25 on the downstream side. More specifically, the gas injection port 29 is formed on the outside to enclose the injection port 23 of the liquid injection nozzle 18 in the acceleration portion. If the front and rear surfaces of the screw shaft portion 28 are formed on the inclined plane,the resistance of the flow path can be reduced. Moreover, a properly shaped support portion having a small air resistance may be provided as support means of the liquid reservoir 4 in addition to the screw shaft portion 28 if necessary.

The pressure gas introduced from the gas introducing port portion is rectilinearly fed in the flow path 2 formed almost rectilinearly, passes through a gap portion around the liquid reservoir 4, is accelerated when passing through the gap portion between a first step inclined surfaces 15 and 24 constituting the accelerating portion, and is further accelerated when passing through the gap portion between the second step inclined surfaces 16 and 25, and is injected at a high speed from the gas injection port 29 formed between the inclined surfaces 16 and 25. On the other hand, the pressure liquid introduced to the liquid introducing port portion 21 resides in the liquid reservoir chamber 19 to smooth a pressure, passes through the flow path 22 and is injected into the central part of the gas flow injected at a high speed from the gas injection port 29 through the injection port 23 formed on the tip portion of the liquid injection nozzle 18. The gas injection port 29 is formed in the middle portion of the inclined surface 16 constituting the accelerating portion. Therefore, the liquid injected from the injection port 23 of the liquid injection nozzle 18 is mixed into the gas injected at a high speed from the gas injection port 29 while being throttled during passing through the inside of the inclined surface 16. Accordingly, the liquid and the gas are promoted to be throttled and mixed in the inside of the inclined surface 16. Thus, a good gas-liquid mixed flow is obtained. The gas-liquid mixed flow is injected from the tip portion while the mixture is further promoted while passing through the nozzle 12. By using the above-mentioned injection system 1, the liquid injected at a high speed from the injection port 23 is mixed with the pressure gas injected at a high speed from the gas injection port 29 through the almost rectilinear flow path 2 having a small reduction in the speed, thereby forming a droplet, and further takes an energy from the injected gas and is sprayed onto the washed surface. Thus, a heavy dirt can also be removed.

Figure 5:
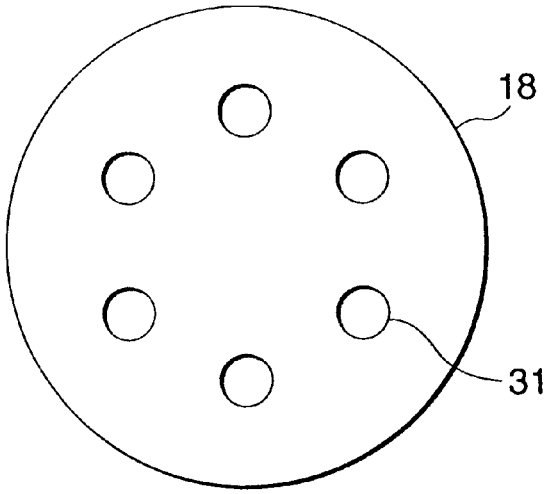
FIG. 5 is an enlarged view showing another embodiment in which an injection is formed in the tip portion of the liquid injection nozzle.

The internal passage of the nozzle 12 for injecting the gas-liquid mixed flow may have the same diameter over the whole length or the injection side of the tip may be tapered to have a slightly larger or smaller diameter. Moreover, the throttle portion 30 having the reduced sectional area of the flow path is formed on the downstream side of the gas injection port 29 in the nozzle 12. Consequently, the gas-liquid mixture can be promoted. Furthermore, it is possible to adjust a region on which the gas-liquid mixed flow is sprayed through the spreading angle on the downstream side of the throttle portion 30. FIG. 5 is an enlarged view showing another embodiment related to the injection port formed in the tip portion of the liquid injection nozzle 18. As shown, in the present embodiment, six injection ports 31 are formed in place of one injection port 23. The number of the injection ports 31 to be provided can be increased or decreased if necessary.

Figure 6:
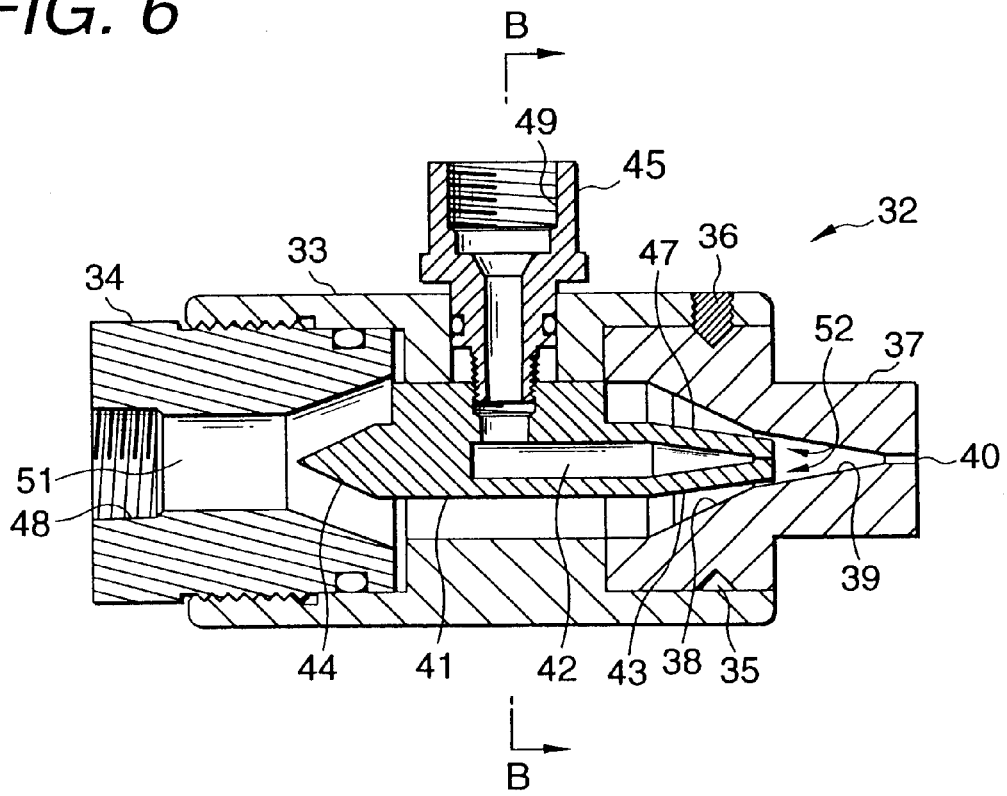
FIG. 6 is a longitudinal sectional view showing an injection apparatus according to yet another embodiment of the invention.
Figure 7:
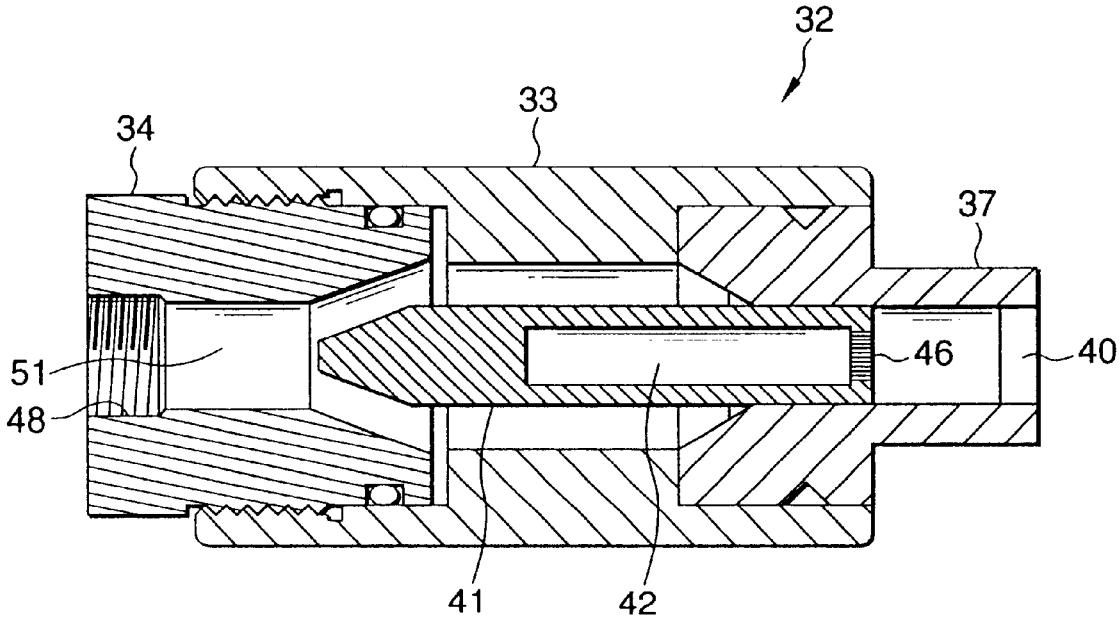
FIG. 7 is a longitudinal sectional view showing the injection apparatus of another embodiment shown in FIG. 6.
Figure 8:
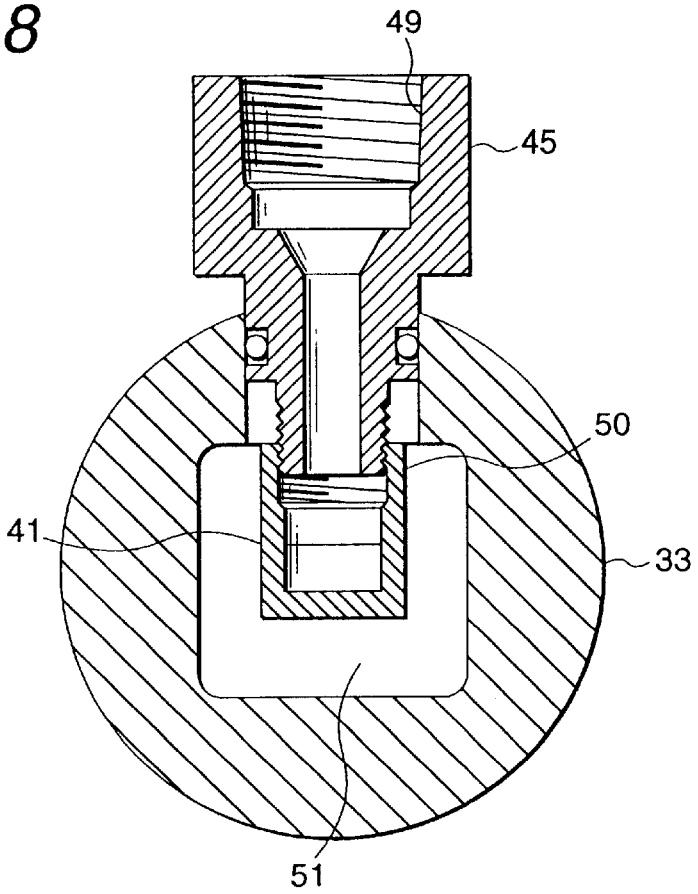
FIG. 8 is a sectional view taken along the line B—B in FIG. 6.
Figure 9:
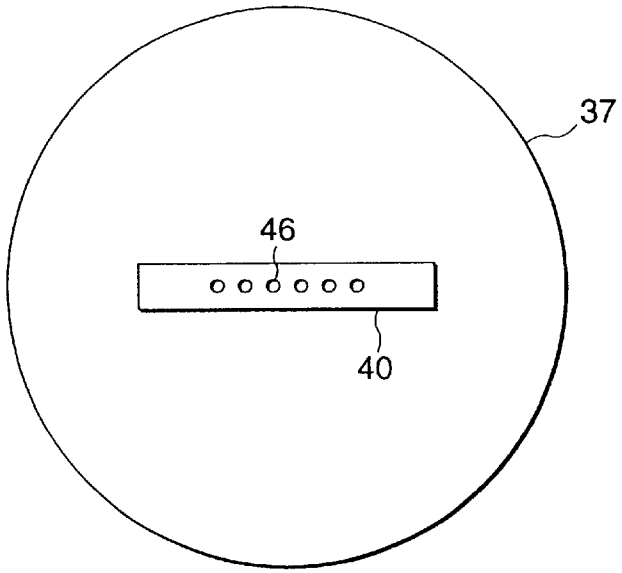
FIG. 9 is an enlarged side view showing a nozzle portion according to the-embodiment.

FIGS. 6 to 9 shows a further embodiment of the injection apparatus. FIG. 6 is a longitudinal sectional view, FIG. 7 is a longitudinal sectional view, FIG. 8 is a sectional view taken along the line B—B, and FIG. 9 is an enlarged side view showing a nozzle portion. As shown, an injection apparatus 32 according to the present embodiment comprises an apparatus body 33 formed having a circular outer shape and an inner rectangular hole portion, a gas introducing port portion 34 screwed and coupled to the upstream side, and a nozzle 37 for a gas-liquid mixed flow which is fitted in a hole portion on the downstream side and is fixed to a V groove 35 formed on an outer peripheral surface with a screw 36. An accelerating portion having upper and lower wall surfaces formed as two-step inclined taper surfaces 38 and 39 is provided integrally with the nozzle 37. By preparing various shapes such as the specific inclination of the accelerating portion, it is also possible to perform exchange depending on-the working conditions. Moreover, an injection port 40 communicating with the inclined surface 39 and having a flow path throttled flatly is formed in the tip portion of the nozzle 37.

The hole portion formed in the apparatus body 33 is formed to have a larger diameter than that of the gas introducing port portion 34, and a liquid reservoir portion 41 is provided in the larger diameter portion. A liquid reservoir chamber 42 is formed in the liquid reservoir portion 41, and a liquid injection nozzle 43 is formed integrally on the downstream side. Moreover, a flat guide surface 44 comprising an inclined surface is formed. Furthermore, a liquid introducing port portion 45 is screwed and coupled to the liquid reservoir portion 41 with communication with the liquid reservoir chamber 42 in a vertical direction. In the present embodiment, a plurality of injection ports 46 are formed in a line on the tip portion of the liquid injection nozzle 43 as shown in FIG. 9, and a flat gas-liquid mixed flow is sprayed through the flat injection port 40 formed on the nozzle 37. Moreover, an external wall surface of the downstream side of the liquid injection nozzle 43 is formed on an inclined surface 47, and the sectional area of the flow path for the pressure gas formed between the inclined surface 47 and the inclined surfaces 38 and 39 is gradually reduced to form an accelerating portion. Female screws 48 and 49 for connecting a supply tube are formed on the upstream side of the internal passage of the introducing port portions 34 and 45.

The liquid reservoir 41 is supported in the apparatus body 33 by screwing a screw shaft portion 50 into the liquid introducing part 45 to maintain a predetermined space defined between an inner peripheral surface of the apparatus main body 33 and an outer peripheral surface of the liquid reservoir 41 so as to form the flow path for the pressure gas as shown in FIG. 8. More specifically, the flow path 51 for the pressure gas according to the present embodiment is formed by the internal passage of the gas introducing port portion 34, a gap portion between the internal wall surface of the gas introducing port portion 34 and the guide surface 44 on the upstream side of the liquid reservoir portion 41, a gap portion between the internal wall surface of the apparatus body 33 and the external wall surfaces of the liquid reservoir portion 41, and a gap portion between the inclined surfaces 38 and 39 formed on the inter wall surface on the upstream side of the nozzle 37 and the inclined surface 47 formed on the external wall surface of the liquid injection nozzle 43, and is provided almost rectilinearly in the same manner as in the above-mentioned embodiment. As described above, the sectional area of the flow path 51 of a pressure fluid which is provided between the inclined surfaces 38 and 39 formed on the internal wall surface at the upstream side of the nozzle 37 and the inclined surface 47 formed on the external wall surface of the liquid injection nozzle 43 is gradually reduced to form the accelerating portion, and the gas injection port 52 for the pressure gas is formed by the upper and lower gap portions between the inclined surface 39 on the downstream side and the inclined surfaces 47. IN the present embodiment, the gas injection port 52 is formed to vertically enclose the liquid jet injected from the injection ports 46 of the liquid injection nozzle 43. The gas injection port 52 is formed in the middle portion of the inclined surface 39 constituting the accelerating portion. In the same manner as the above-mentioned embodiment, the liquid injected from the injection ports 46 of the liquid injection nozzle 43 is throttled while passing through the inside of the inclined surface 39, and is mixed into the gas injected at a high speed from the gas injection port 52. Accordingly, the liquid and the gas are promoted to be mixed while being throttled on the inside of the inclined surface 39. Consequently, a good flat gas-liquid mixed flow can be obtained from the injection port 40 of the nozzle 37.

Figure 10:
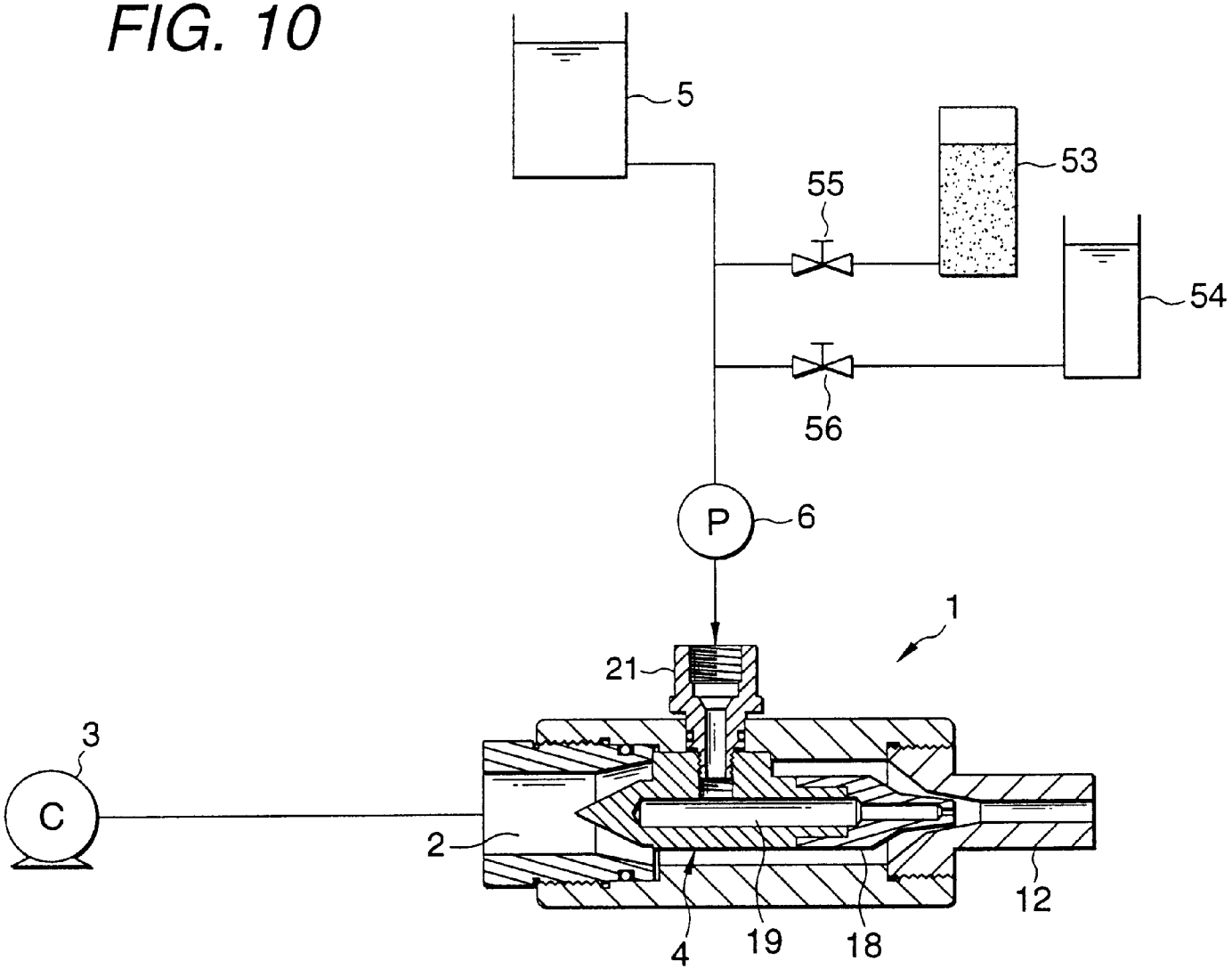
FIG. 10 is a diagram schematically showing a circuit structure in a main part according to a further embodiment in which the invention is applied to washing use.

FIG. 10 is a diagram showing another circuit structure in which the present invention is applied to washing use. In the present embodiment, the case in which an injection apparatus 1 is used according to a variant of the embodiment shown in FIG. 1. A media water stock solution tank 53 having water a powder and granular material mixed therein and a detergent stock solution tank 54 are connected, through valves 55 and 56, to the middle of a water tank 5 provided on the upstream side of the liquid introducing port portion 21, respectively. In the present embodiment, the valves 55 and 56 are switched adjustably. Consequently, it is possible to adjust the presence of the mixture of a powder and granular material and a detergent into the pressure liquid supplied from the liquid injection nozzle 18 through the liquid introducing port portion 21 and the amount of the mixture thereof. In that case, it is also possible to select the way of supply depending on the type of the powder and granular material.

According to the present invention, the following effects can be obtained.

Since the flow path for the pressure gas in the injection apparatus is formed almost rectilinearly, the resistance of the flow path can be reduced. Accordingly, the smooth flowing state of the pressure gas is obtained, and furthermore, the capability of a pressure gas generator can be reduced effectively.

The pressure gas is wholly introduced from the pressure gas generator to the flow path in the injection apparatus, and the flow of the pressure gas is formed almost rectilinearly. Consequently, the flow can be uniformly formed over the whole flow path section. Accordingly, the flow of the pressure gas can be smoothly obtained without disturbance differently from the conventional art. Consequently, a stable good injection state can be obtained.

The injection state is stabilized by the uniform flow of the pressure gas. Therefore, the adjustable range for the injection state can also be enlarged.

The gas jet is injected to enclose the liquid jet in the accelerating portion of the pressure gas, thereby forming the gas-liquid mixed flow. Therefore, the mixture can be promoted and a good gas-liquid mixed flow can be obtained.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. An injection apparatus for a gas-liquid mixed flow which mixes and injects at least a pressure gas and a pressure liquid, comprising:

a flow path formed within an elongated apparatus body for the pressure gas to be connected to a pressure gas feeder and being formed almost rectilinearly;

a liquid reservoir being provided in said flow path for the pressure gas, and to be connected to a pressure liquid feeder;

an accelerating portion which is formed by gradually reducing a sectional area of said flow path for the pressure gas;

an injection port of a liquid injection nozzle communicating with the liquid reservoir, said injection port being provided in said accelerating portion; and a gas injection port being formed outside of said injection port of the liquid injection nozzle.

2. An injection apparatus for a gas-liquid mixed flow according to claim 1, wherein said gas injection port is formed by an internal wall surface of the accelerating portion and an external wall surface of the liquid injection nozzle.

3. An injection apparatus for a gas-liquid mixed flow according to clam 1, wherein a throttling portion having a sectional area reduced is provided on a nozzle for mixed flow injection on a downstream side of the gas injection port.

4. An injection apparatus for a gas-liquid mixed flow according to claim 1, wherein a plurality of injection ports are provided on the liquid injection nozzle.

5. An injection apparatus for a gas-liquid mixed flow which mixes and injects at least a pressure gas and a pressure liquid, comprising:

a flow path for the pressure gas to be connected to a pressure gas feeder and being formed almost rectilinearly;

a liquid reservoir being provided in said flow path for the pressure gas, and to be connected to a pressure liquid feeder;

an accelerating portion which is formed by gradually reducing a sectional area of said flow path for the pressure gas;

an injection port of a liquid injection nozzle communicating with the liquid reservoir, said injection port being provided in said accelerating portion; and a gas injection port being formed outside of said injection port of the liquid injection nozzle, wherein a plurality of injection ports are provided on the liquid injection nozzle and, wherein the injection ports of the liquid injection nozzle are arranged in a line and the gas injection port is formed in a substantially flat shape.

6. An injection apparatus for a gas-liquid mixed flow according to claim 2, wherein said gas injection port is removably fitted to the elongated apparatus body so that the accelerating portion is variable in shape.

7. An injection apparatus for a gas-liquid mixed flow according to claim 1, wherein a powder and granular material feeding portion is provided on an upstream side of the injection port of the pressure gas.

8. An injection apparatus for a gas-liquid mixed flow according to claim 7, wherein a liquid feeding portion for preventing residence of the powder and granular material is provided on a downstream side of the powder and granular feeding portion.

9. An injection apparatus for a gas-liquid mixed flow according to any of claim 1, wherein a powder and granular material feeding portion is provided on an upstream side of the injection port of the pressure liquid.

10. An injection apparatus for a gas-liquid mixed flow according to claim 1, wherein a detergent solution tank supplies detergent to the pressure liquid feeder.

* * * * *